US006536079B2

(12) United States Patent
Hill

(10) Patent No.: US 6,536,079 B2
(45) Date of Patent: Mar. 25, 2003

(54) FOLDING FURNITURE HINGE/LOCKING DEVICE

(76) Inventor: Steven Gene Hill, 522 Palmer La., Menlo Park, CA (US) 94025

( * ) Notice: Subject to any disclaimer, the term of this patent is extended or adjusted under 35 U.S.C. 154(b) by 55 days.

(21) Appl. No.: 09/863,495

(22) Filed: May 24, 2001

(65) Prior Publication Data

US 2002/0174516 A1 Nov. 28, 2002

(51) Int. Cl.[7] ..... E05D 11/10

(52) U.S. Cl. ..... 16/326; 16/321; 16/324; 16/352; 108/168; 297/463.1

(58) Field of Search ..... 16/230, 231, 321, 16/324, 326, 327, 349, 352; 108/168; 297/463.1

(56) References Cited

U.S. PATENT DOCUMENTS 4,608,729 A * 9/1986 Huang ..... 16/331
4,842,292 A * 6/1989 Wang ..... 280/278
6,290,297 B1 * 9/2001 Yu ..... 297/378.12
6,409,205 B1 * 6/2002 Bapst et al. ..... 280/642

* cited by examiner

*Primary Examiner*—Gary S. Hartmann
(74) *Attorney, Agent, or Firm*—Patent & Trademark Services; Thomas Zack; Joseph H. McGlynn

(57) ABSTRACT

A locking assembly mounted to a first rigid member by a hinge on one end of the member. The locking assembly can be locked to the first member to retain a second rigid member by an extending pin. The locking assembly is locked in place on the first member by an extendable locking pin whose end can engage a stop post in the first member when pivoted to a locked position.

7 Claims, 4 Drawing Sheets

FIG.4(a)
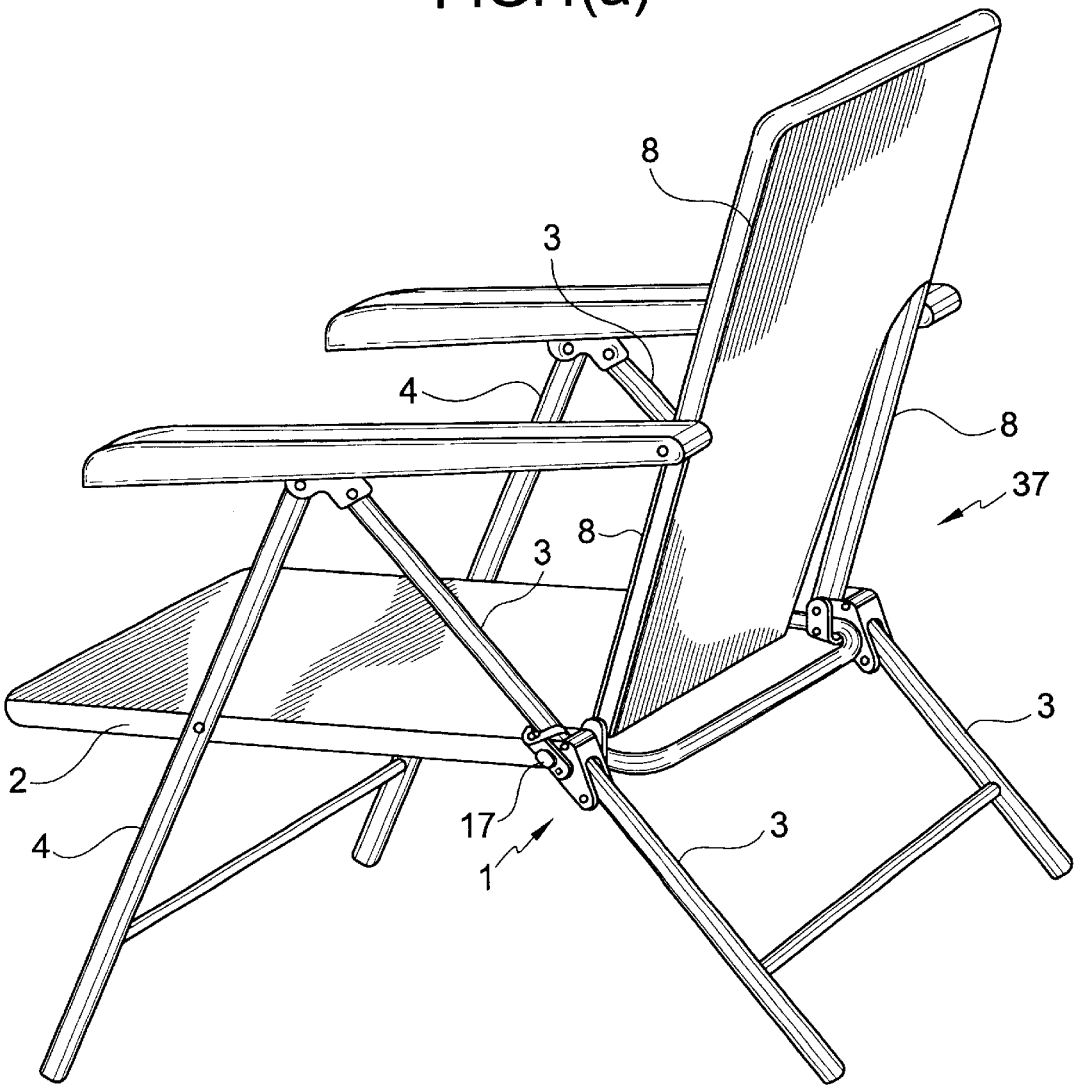
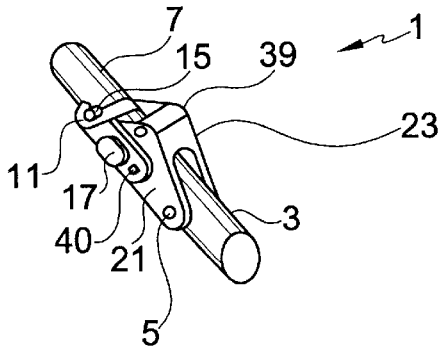
FIG.4(b)

FOLDING FURNITURE HINGE/LOCKING DEVICE

BACKGROUND OF THE INVENTION

This invention relates to a hinge device that has a lock which can be used on foldable furniture.

Foldable furniture such as chairs, chaise lounges and the like are well known and have been used for many years. While very useful for their intended purposes, such furniture may move from their opened position to a partially or completely folded (collapsed) position if the hinge joint joining the folding members becomes unstable. A user may as a result fall to the ground. This movement of the members may be due to movement of the user when in a seated position or may be due to other reasons, such as the movement of the hinged members relative to each other. Whatever the reason, it would be very desirable for the unfolded furniture to remain in position until the user desires to fold the same for transport or storage.

DESCRIPTION OF THE PRIOR ART

Locking devices that can be used to lock two legs or leg segments joined by a hinge connection are known. One such locking device consisting of a pivotally mounted locking member fixed to one member that can be moved to end another lug stop type member fixed on the second member.

In the present invention the hinge mounted on a first rigid member has an extension with a safety locking assembly. The assembly keeps the chair seat back and the seat base frame from collapsing. Incorporated into the locking assembly is an extended end which can engage a stop member on a first member to lock the first and second members together, all as Will be detailed in the specification that follows hereafter.

SUMMARY OF THE INVENTION

This invention relates to a locking assembly mounted to a first rigid member, like a leg or frame member of a foldable chair, by a hinge joint on one end of the member. The locking assembly can be locked to the first member to retain a second rigid member by an extending pin. The locking assembly is locked in place on the first member by an extendable locking pin whose end can engage a stop post in the first member when pivoted to locked position.

It is the primary object of the present invention to provide for an improved locking device for foldable furniture or the like.

Another object is to provide for such a device in which one member has a locking assembly mounted at one end by a hinge connection to the same first member which, when locked in place on that member, retains a second rigid member to the first member by a pin.

These and other objects and advantages of the present invention will become apparent to readers from a consideration of the ensuing description and the accompanying drawings.

BRIEF DESCRIPTION OF THE DRAWINGS

FIGS. 3(*a*) and 3(*b*) are a plan view and a side view of the latch release mechanism of the present invention.

FIG. 4(*a*) is a perspective view of the FIG. 2 locking assembly when mounted on a leg member of an unfolded chair.

FIG. 4(*b*) is an enlarged perspective view of the locking assembly used in FIG. 4(*a*).

DESCRIPTION OF THE PREFERRED EMBODIMENT

Figure 1:
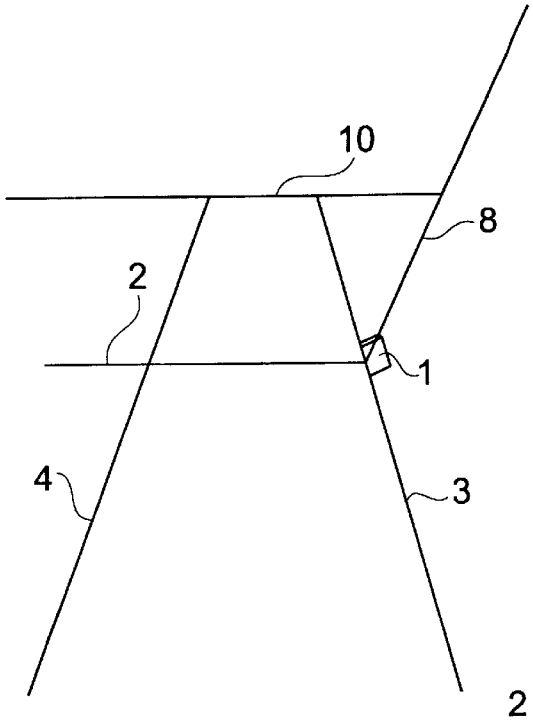
FIG. 1 is a schematic diagram of the tubular components of a typical chair embodying the present invention.

In a typical folding chair embodying the present invention, such as shown in the FIG. 1 schematic diagram, there would be a tubular interconnected structure consisting of joined horizontal disposed seat tubes 2, a pair of vertically disposed front legs tubes 4 and a pair of rear leg tubes 3, folding chair seat back tubes 8 and handle or armrest tubes 10. In the present invention, one or both of the rear leg tubes 3 may have the locking assembly 1 shown in FIG. 2.

Figure 2:
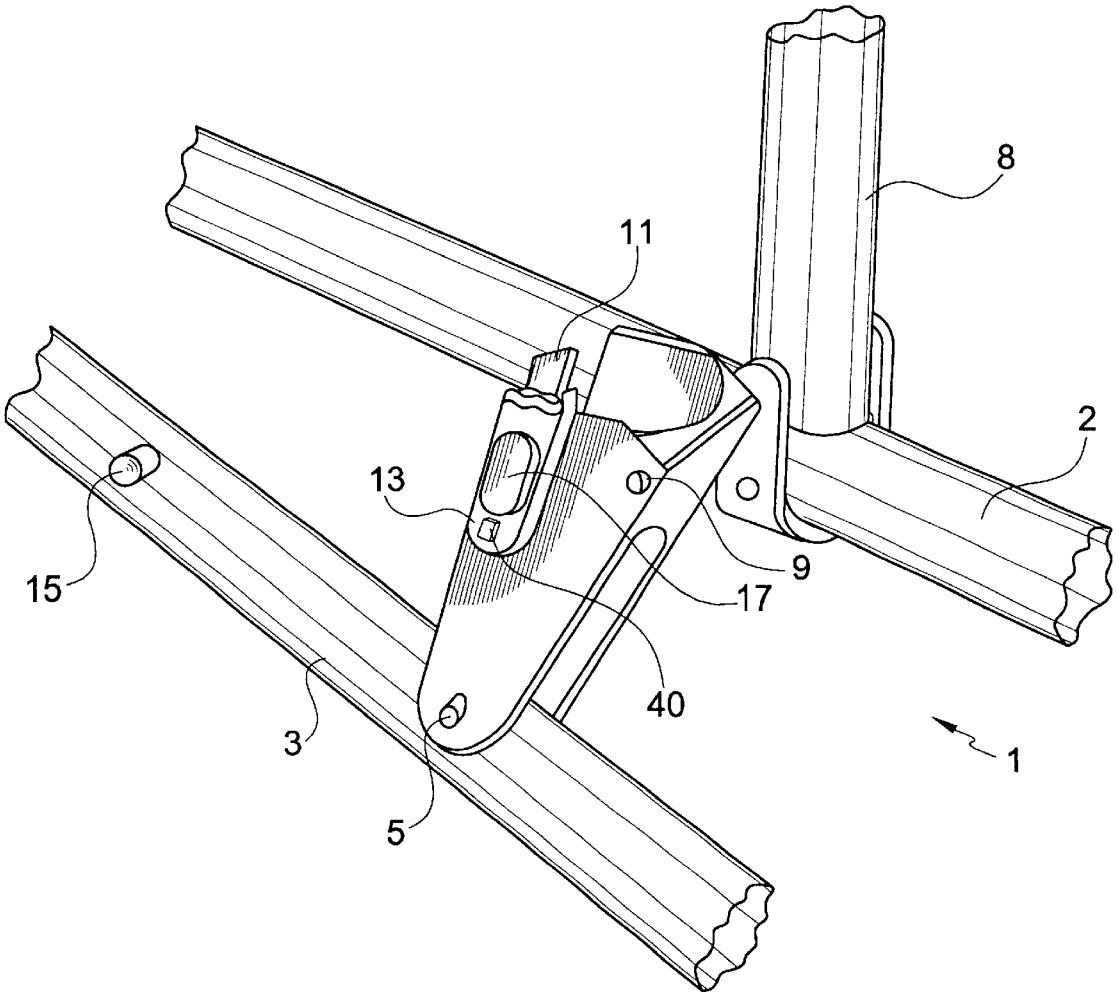
FIG. 2 is an enlarged perspective view of the present invention showing the locking assembly mounted to a first leg member by a hinge connection with a pin extending to a second member.

As shown in the FIG. 2 enlarged perspective view, the locking assembly 1 is mounted to the elongated rigid leg member 3, the rear chair leg tube, by a hinge connection 5. The locking assembly 1 has two ends, with the first end being pivotally mounted by the hinge connection 5 to the member 3. The opposite, or second, end of the assembly has a hollow interior with an opened end that can receive a second portion of the same rigid elongated chair leg tube member 3. A holding fastener, like pin 9, is inserted through a hole or aperture in the assembly 1 and extends through to a second member on which it bears (the chair seat back rest tube 8 in FIG. 2) to retain member 3 in place with respect to the second member 8.

On one side of the assembly 1 is a retractable locking latch pin 19 whose exposed end 11 is shown. Pin 19 slides within the side housing or pocket 13, molded into the outside surface of the assembly 1. Housing 13 acts like a pocket with an opened end for the movable latch pin 19 and has its rear end and sides closed. The internal sides of the pocket on housing 13, as best shown in FIG. 3, has an opened slot running lengthwise to receive a protruding tab fixed to the end of the latch pin.

The front of the pin end 11 is curved or slanted such that when the assembly 1 is moved downwardly towards the stop post 15, which is fixed to and extends from the surface of member 3, its curved edge will ride along the round surface of the post 15 until it reaches the end 11 of pin 19. As pin end 11 moves against the post 15 it will retract into the housing 13 against the action of an internal spring 27, shown in FIG. 3, Spring 27 normally biases the latch pin outwardly from the pocket 13. When the post 15 is fully engaged by the exposed end 11, it is locked in place on rigid member 3 until the reciprocable button 17 on housing 13 is manually moved to retract the extended latch pin 19, as will be explained in more detail below.

The rigid elongated member 3 can be made of a hollow plastic material or may be made of a hollow metal material to provide for a light weight structure such as is commonly found in the leg and frame members of lawn, beach and other furniture which are collapsible or foldable.

Figure 3:
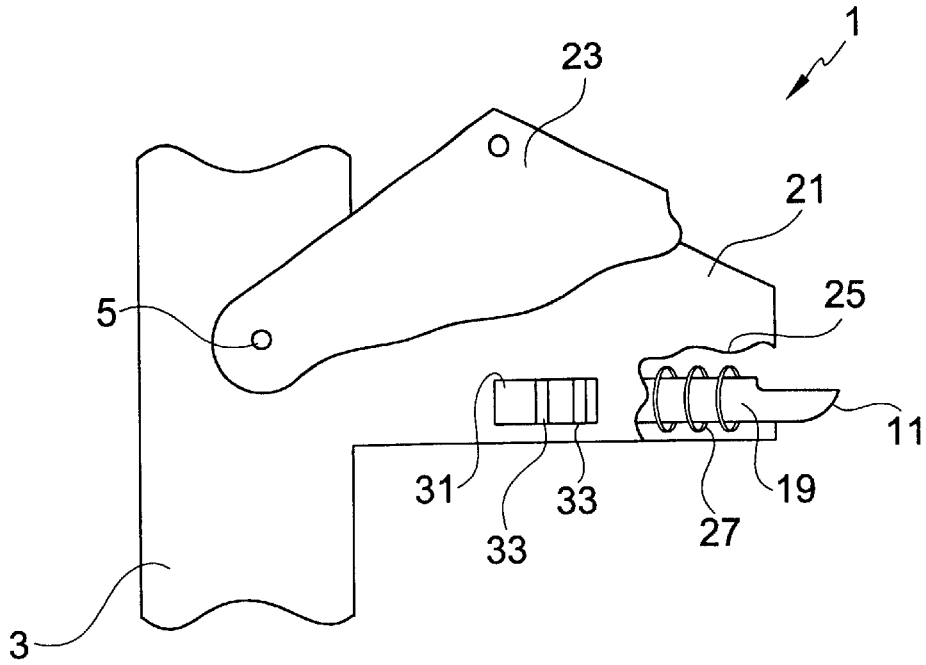
FIG. 3 is an enlarged perspective view of the locking assembly of FIG. 2 from another angle with a surface portion cut away to show the internal movable locking latch pin.
Figure 3A:
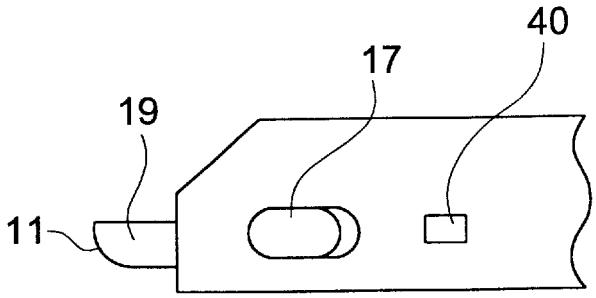
Figure 3B:
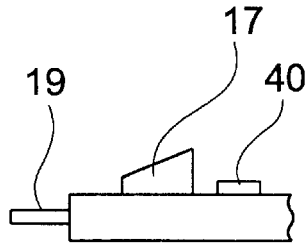

FIG. 3 is an enlarged view of the locking assembly 1 of FIG. 2 with a surface portion cut away at 25 to show the internal locking latch pin 19. The assembly 1 comprises two side sections 21, 23 which are joined by a cross member 39 (see FIG. 4(*b*)). Section 23 is cut away in FIG. 3 to show the inside of section 21.

The cut away portion 25 of surface section 21 reveals the locking latch pin 19 with an encircling biasing spring 27, which normally biases the pin 19 out of the housing 13. This type of biasing spring is conventional and, therefore, its structure and how it is attached to the pin 19 is not shown. Only the exposed latch pin end 11 extends beyond the pocket 13. An elongated slot 31 is formed in the surface 21. A tab 33 is affixed to one side of the pin 19 and the tab 33 protrudes through the slot 31. Tab 33 consists of two exposed members which are spaced apart. Tab 33 is fixed to the pin 19 at its rear end and moves with the pin. When the pin 19 moves to the left, as shown in FIG. 3, one of the tabs 33 engages one end of the slot 31, and when the pin moves to the right, the other tab 33 engages the other end of the slot 31 to limit the travel of the pin 19. It should be noted that although two tabs 33 are preferred, a single tab, one side of which engages one end of the slot 31 and a second side of the tab engages the other side of the slot could be used to limit the travel of the pin 19.

FIGS. 3(*a*) and 3(*b*) show the pin release mechanism in more detail. A button 17 is attached to a side of pin 19 and moving the button 17 to the right in FIG. 3(*a*) will retract the pin 19 into the housing 13 against the bias of spring 27. This will release the pin from locking engagement with pin 15 and allow the chair to be folded. Since button 17 will have to be held in the rearward position by the user during the folding of the chair, it is sometime more convenient to lock button in the release position. This is accomplished by means of ramp 40. As button 17 is moved to the right in FIG. 3(*a*), it will engage onto ramp 40 which will hold it in the retracted position. This will hold pin 19 in a retracted position to allow easy folding of the chair without manually holding the button 17 in the retracted position. In order to release the button 17 from the ramp 40 it is only necessary to slide the button 17 toward the left in FIG. 3(*a*). It should be noted that ramp 40, in FIG. 3(*b*) is drawn out of scale for purposes of clarity.

FIG. 4(*a*) is a perspective view of the FIG. 2 locking assembly 1 when mounted to the rear leg 3, of a foldable chair 37. As shown, the chair is in an unfolded position with the locking assembly locked in place with its pin 19 extend to lock members 3 and 8 with respect to each other. In FIG. 4(*b*) an enlarged view is shown of the leg member locking mechanism 1. The hinge connection 5 is a pin that goes through apertures in the two sections 21 and 23 and aligned holes in member 3. The ends of this pin may be expanded outwardly, like a flattened rivet at both ends, to prevent the pin from falling from the holes in the sections 21 and 23 and the member 3. The protruding post 15 is shown engaged by the exposed end 11 of the extended latch pin 19. As mentioned previously with respect to FIG. 2, there is a joining or spanning portion 39 in assembly 1 between the parallel spaced sections 21 and 23 and this is shown in both the normal and enlarged views of the assembly 1.

Two identical assemblies such as assembly 1 may be used on opposite sides of the chair 37 to join two different leg segments. In FIG. 4(*a*) the rigid members on each side have the numbers 3 for the identical rear leg members, as shown. The lock retaining tab 33 used in each assembly is not shown in FIG. 4(*a*), as they face each other. The latching mechanism is disengaged by moving the button 17 (see FIG. 4(*b*)) which retracts the latch pin 19 back into the housing 13 and out of engagement with pin 15. There is also a convenience feature where you can push up on the button 17 toward pivot pin 5 until the button 17 rides up on ramp 40 (see FIG. 3(*a*) and 3(*b*)). In this position, the release button 17 will be locked in a rearward position. In this position, pin 19 will be held in a retracted position in housing 13, and, therefore, will be unable to latch onto the pin 15. This will allow a user to fold the chair normally without having to hold down the button 17 to keep the latch retracted while also trying to fold the chair.

Figure 5:
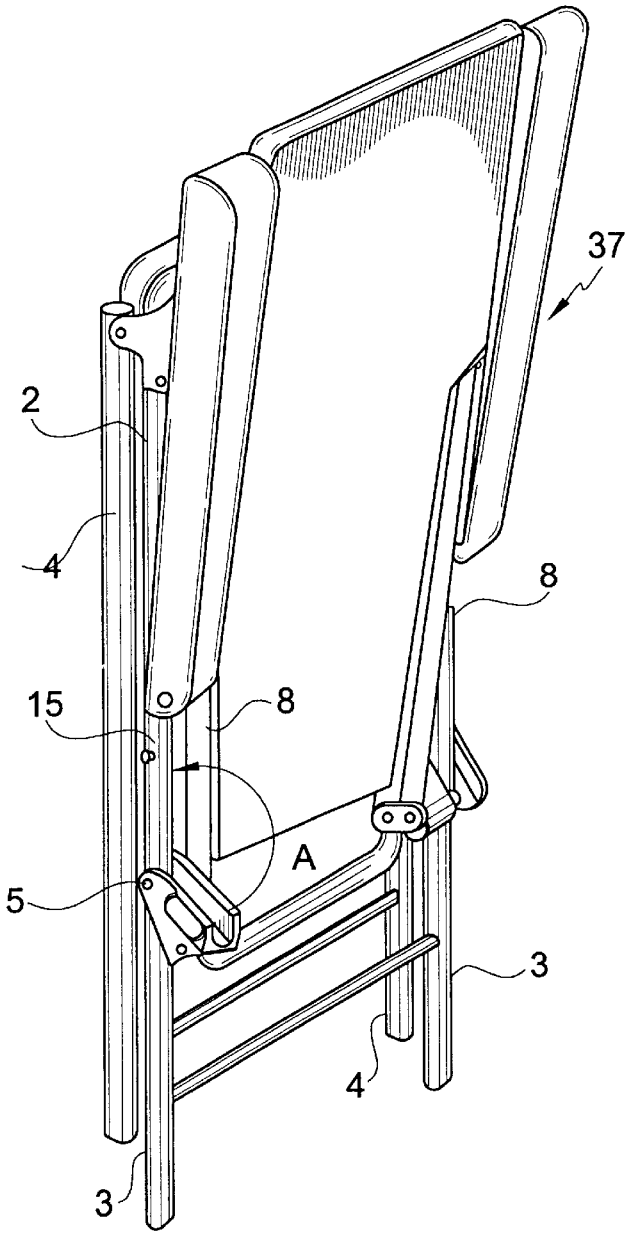
FIG. 5 is a perspective view of the chair of FIG. 4(*a*) when the locking assembly is unlocked and the chair is in a folded position.

FIG. 5 is a perspective view of the chair 37 of FIG. 4(*a*) when the locking assembly 1 is unlocked and the chair is in a closed or folded position. The arrow A indicates the direction the locking assembly 1 must be pivoted to have its extended end 11 engage the post 15. In this view the upper member 7 which fits into the opened end of the assembly 1 is not shown.

When the assembly 1 is locked in place on the rigid member 3, the extended end 11 bears against a side of the fixed post 15 to retain it in position. The internal encircling spring 27 maintains the latch 19 in the extended position until a user manually slides the button 17 to disengage the latch. When fully retracted, the exposed tab 33, fixed to the latch pin 19 moves with the latch pin until the tab engages the ends of the slot 33. When this happens, the latch is locked in a retracted position and remains so until a user releases the latch by sliding back the button 17, which retracts the pin 19 into the housing 13 and disengages it from the pin 15.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A locking hinge device for folding furniture comprising:

a first member having a locking assembly mounted on the first member, said locking assembly having a first end and a second end, said locking assembly being mounted on the first end by a hinge connection to the first member, a stop post extending from the first member;

a second member spaced from and retained to said first member by a hinged connection, whereby said first and second members can pivot with respect to each other, said locking assembly having a hollow interior portion to receive the second member, said locking assembly also having a latch means for engaging said stop post mounted on said first member to lock the first member and the second member with respect to each other, said latch means having a tab attached to one side of said latch means, said housing having a slot to receive said tab, and said slot and said tab limiting the amount said latch means can travel out of said housing.

2. A locking hinge device for folding furniture comprising:

a first member having a locking assembly mounted on the first member, said locking assembly having a first end and a second end, said locking assembly being mounted on the first end by a hinge connection to the first member, a stop post extending from the first member;

a second member spaced from and retained to said first member by a hinged connection, whereby said first and second members can pivot with respect to each other, said locking assembly having a latch means for engaging said stop post mounted on said first member to lock the first member and the second member with respect to each other, said latch means being mounted within a housing, said latch means being movable from a first position to a second position, when in said first position said latch means is at least partially outside said housing and, when in said second position said latch means is retracted within said housing.

3. The locking hinge device as claimed in claim 2, wherein said latch means is held in said first position by a spring.

4. The locking hinge device as claimed in claim 2, wherein said latch means has a release means, attached thereto, for manually moving said latch means from said first position to said second position.

5. The locking hinge device as claimed in claim 4, wherein said latch means has a tab attached to one side of said latch means, and said housing has a slot which receives said tab, and said release means is mounted to said latch means on a side of said latch means which is opposite to said one side.

6. The locking hinge device as claimed in claim 4, wherein said housing has means for holding said release means and said latch means in said second position.

7. The locking hinge device as claimed in claim 6, wherein said means for holding said release means and said latch means in said second position is a ramp.

* * * * *